US006234245B1

(12) United States Patent
Reid et al.

(10) Patent No.: US 6,234,245 B1
(45) Date of Patent: May 22, 2001

(54) AERO CURVE FIN SEGMENT

(75) Inventors: Don R. Reid, Jenks; Hartman Mitchell, Tulsa; Robert C. Weierman, Pryor, all of OK (US)

(73) Assignee: Fintube Technologies, Inc., Tulsa, OK (US)

( * ) Notice: Subject to any disclaimer, the term of this patent is extended or adjusted under 35 U.S.C. 154(b) by 0 days.

(21) Appl. No.: 09/109,981

(22) Filed: Jul. 2, 1998

(51) Int. Cl.[7] ..... F28F 1/36
(52) U.S. Cl. ..... 165/181; 165/184
(58) Field of Search ..... 165/181, 184, 165/182

(56) References Cited

U.S. PATENT DOCUMENTS

| | | | | |
|---|---|---|---|---|
| 808,490 | * | 12/1905 | Swan | 165/184 |
| 2,965,555 | | 10/1960 | Hall | 165/181 X |
| 3,073,385 | | 1/1963 | Peters . | |
| 3,183,970 | | 5/1965 | Worley . | |
| 3,723,693 | | 3/1973 | Boose et al. . | |
| 3,752,228 | * | 8/1973 | Bosse | 165/184 |
| 4,227,572 | | 10/1980 | Harlan | 165/184 |
| 4,258,782 | * | 3/1981 | Kao | 165/184 X |
| 5,240,070 | | 8/1993 | Ryan | 165/184 |

FOREIGN PATENT DOCUMENTS

| | | | | |
|---|---|---|---|---|
| 235639 | * | 4/1945 | (CH) | 165/184 |
| 1939199 | * | 2/1971 | (DE) | 165/184 |
| 0091127 | | 6/1983 | (EP) . | |
| 340765 | * | 1/1931 | (GB) | 165/181 |
| 579610 | * | 8/1946 | (GB) | 165/184 |
| 906282 | | 9/1962 | (GB) . | |
| 5-130598 | | 10/1981 | (JP) | 165/184 |
| 86896 | * | 5/1984 | (JP) | 165/184 |
| 507767 | * | 4/1976 | (SU) | 165/184 |
| 1059412 | * | 12/1983 | (SU) | 165/181 |
| 1560977 | * | 4/1990 | (SU) | 165/184 |

* cited by examiner

*Primary Examiner*—Leonard Leo
(74) *Attorney, Agent, or Firm*—Molly D. McKay

(57) ABSTRACT

A new type of segmented fin 12 for use on a finned tube 18, the unique type of finned tube 18 that is created with the new type of segmented fin 12, specialized serrating wheels 14 and 16 for creating the new type of segmented fin 12, and the process 10 for employing the specialized serrating wheels 14 and 16 to create the new type of segmented fin 12. Each of the segments 26 of the new type of segmented fin 12 is permanently curved, and the segments 26 are coined to increase surface area of the segments 26 and to further shape the sheared edges 42 and 44 of the segments 26 into a more pointed configuration in order to make them more aerodynamic.

14 Claims, 9 Drawing Sheets

AERO CURVE FIN SEGMENT

BACKGROUND OF THE INVENTION

1. Field of the Invention

The present invention relates to a new type of segmented fin for use on a finned tube, specialized serrating wheels for creating the new type of segmented fin, and the process for employing the specialized serrating wheels to create the new type of segmented fin.

The new type of segmented fin is unique because it is provided with individual segments that are curved in order to increase the heat transfer rate of the finned tube that is created when the fin is welded onto a heat exchanger tube. In addition, the segments are coined by the specialized serrating wheels, thus increasing the surface area of the segments and further shaping the sheared edges of each of the segments to result in segments with less air drag.

2. Description of the Related Art

Adding fins to the external surface of a heat exchange tube is an old and well-known way to increase the heat transfer rate between the exterior of the tube and the interior of the tube. Increased heat transfer rate is desirable because the purpose of the heat exchange tubes is to transfer heat between a liquid or gas located within the tube and a liquid or gas located outside the tube. Fins are normally attached to the external surface of the finned tube by employing a long, continuous fin that is wound in helical fashion around the tube so that the fin extends approximately perpendicular to the tube's longitudinal axis.

The practice of serrating the outward extending side of the fin to create segments in the fin prior to winding the flat, non-serrated inwardly extending side or base of the fin to the tube is also a commonly employed way of further increasing the heat transfer rate of the finned tube.

In addition, a variety of surface enhancements to the serrated portion of the fin have been proposed as means for further increasing the surface area of the segments and thus increase the heat transfer rate of the finned tube. One of the disadvantages of creating most of these types of surface enhancements in the segments is that the enhancements increase drag on the outside of the finned tube, either by the gas or liquid flowing past the fins external to the tube.

The present invention further increases the heat transfer rate of serrated finned tubes by creating a serrated fin that has curved segments. Each of these curved segments is concave on one side of the segment and is convex on the opposite side of the segment. This curvature of the segments results in better attachment of the external gas or liquid to the surfaces of the segments, resulting in a higher heat transfer rate. The curvature of the segments also makes them stronger. In addition, the segments are coined or pressed between the serrating wheels to further increase the surface area of the segments and to shape the edges of the segments. Increasing the surface area of the segments allows them to be more efficient at transferring heat and shaping the edges of the segments allows them to be more aerodynamic so that there is decreased drag on the fin when the finned tube is in service.

Finally, after serrating and coining the segments, the segments are passed between a final set of wheels in order to precisely align the segments relative to their base, making the fin ready for winding onto the tube to create a finned tube.

SUMMARY OF THE INVENTION

The present invention consists of a process for creating a new type of segmented fin, specially designed serrating wheels for creating the new type of segmented fin, the new type of segmented fin thus produced, and the unique type of finned tube that is created with the new type of segmented fin.

The method involves first passing a flat metal fin strip between two specially designed serrating wheels. Each of the specially designed serrating wheels is provided with a series of cutting edges around the wheel's perimeter. One of the wheels is provided around its perimeter with a series of concave surfaces, with one such concave surface being located between each adjacent pair of cutting edges provided on that first wheel. The other wheel is provided at its perimeter with a series of convex surfaces, with one such convex surface being located between each adjacent pair of cutting edges provided on that second wheel. The cutting edges of the two wheels are aligned with each other in cooperating fashion so that when the flat fin strip is passed between the wheels, the outward extending side of the fin is serrated by the cooperating cutting edges of the wheels, but the base of the fin strip remains unserrated.

The convex and concave surfaces of the two wheels are engaged and mated so that as the serrated portion of the fin completes its travel between the wheels, the segments are pressed or coined between the opposing convex and concave surfaces. This coining causes each of the segments to be stressed beyond the yield point of the metal and thereby causes each of the segments to be permanently bent into a curved configuration corresponding to the curvature of the mating concave and convex surfaces of the first set of wheels.

Once the serrated and coined fin completes its travel through the wheels, the base of the fin is then engaged by a second set of wheels that serve to apply a pulling force on the fin in order to pull it clear of the first set of wheels with sufficient tension so as to elongate the base of the fin. It is important that the second set of wheels engage only the base of the fin so that the curvatures of the serrations are not disturbed by the gripping action of the second set of wheels.

Finally, after the serrated and coined fin passes between the second set of wheels, it passes between a third set of wheels. The wheels comprising the third set of wheels are precisely spaced apart from each other so that as the segments pass between the third set of wheels, the segments are realigned with the longitudinal axis of the base without disturbing the curvature of the segments.

The final result of this process is a serrated fin having curved segments. Each segment is curved in a plane approximately parallel to the longitudinal axis of the fin's base so that each segment is provided with a concave side and an opposite convex side, with the two sides meeting at the serrated edges.

Also because of the coining process that the segments undergo as they pass between the serrating first set of wheels, the surface area of the segment is slightly increased and the edges of the segments are slightly pointed.

One of the added benefits of producing a fin with curved segments is that the segments, by virtue of their curved configuration, are inherently stronger. A segment will resist deflection by an amount that is proportional to the moment of inertia, and the moment of inertia is proportional to the cube of the thickness of the fin, including its curvature. Thus, by creating a curvature in the segments, the fin's apparent thickness is increased and also the strength of the segment is increased.

DETAILED DESCRIPTION OF THE PREFERRED EMBODIMENT

Invention

Figure 1:
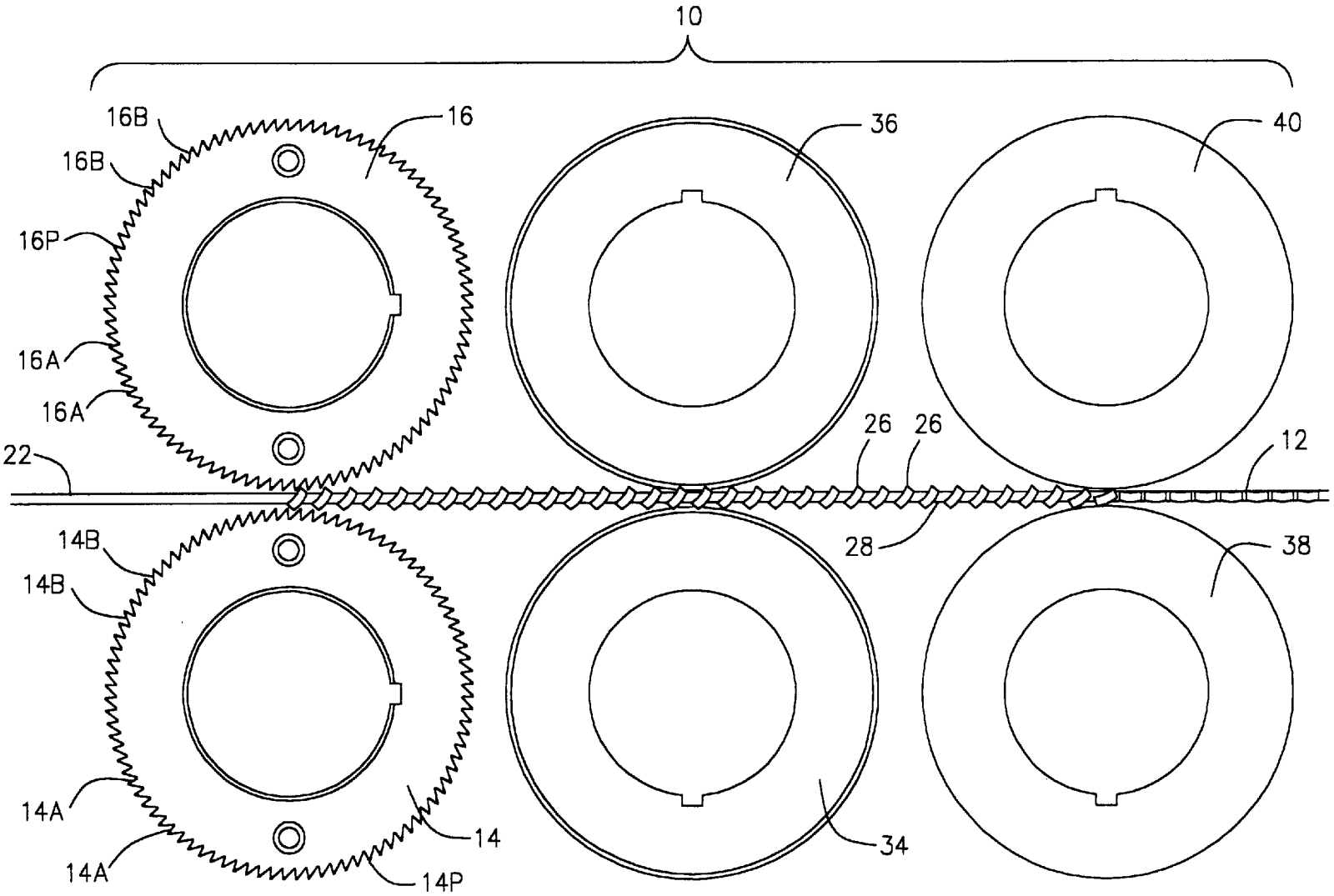
FIG. 1 is a schematic diagram illustrating the specialized serrating wheels and the process for creating from a flat fin strip a new type of aerodynamically curved segmented fin that is the subject of the present invention.
Figure 2:
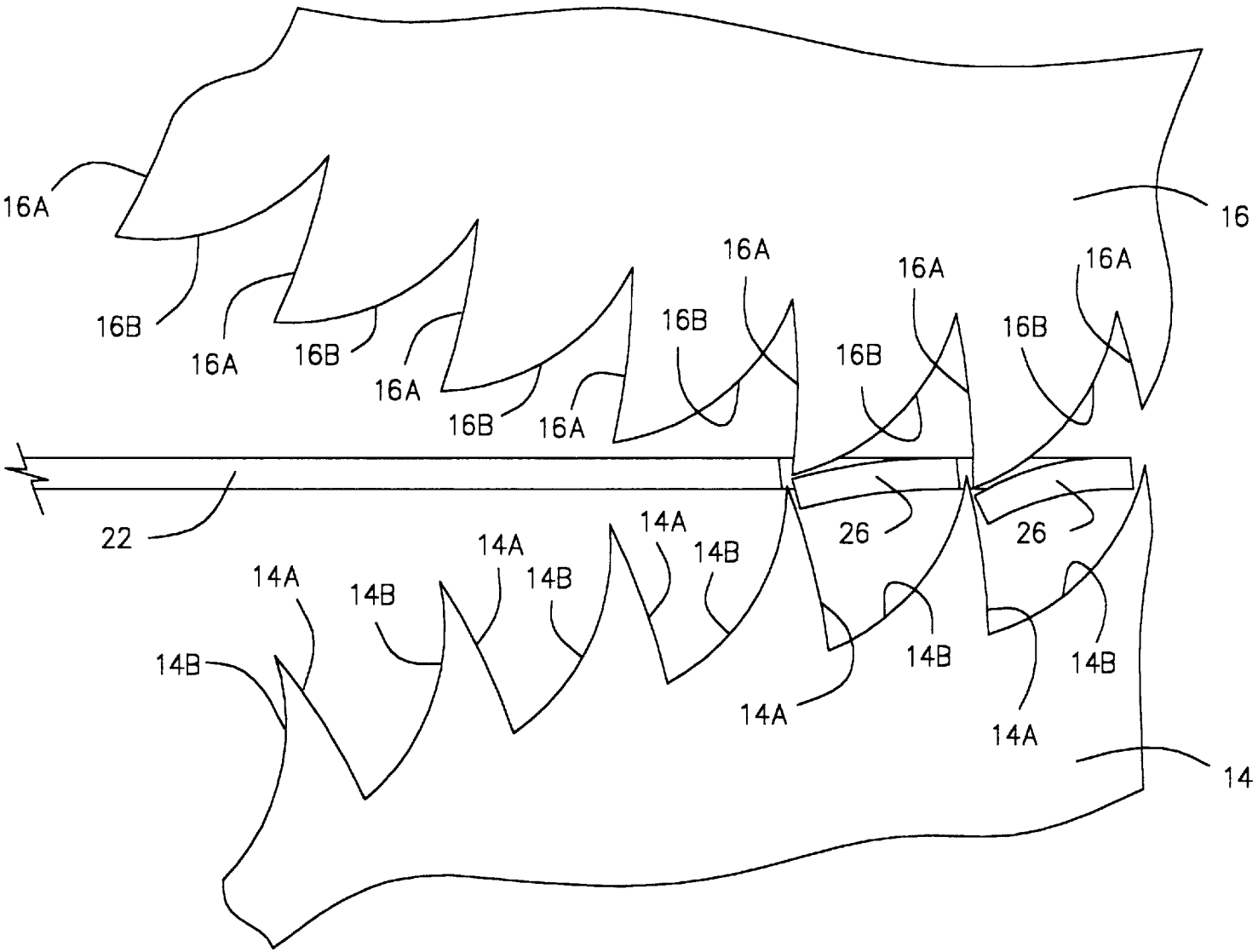
FIG. 2 is an enlarged view of a flat fin strip as it enters and is being serrated by the serrating first set of wheels in FIG. 1.
Figure 3:
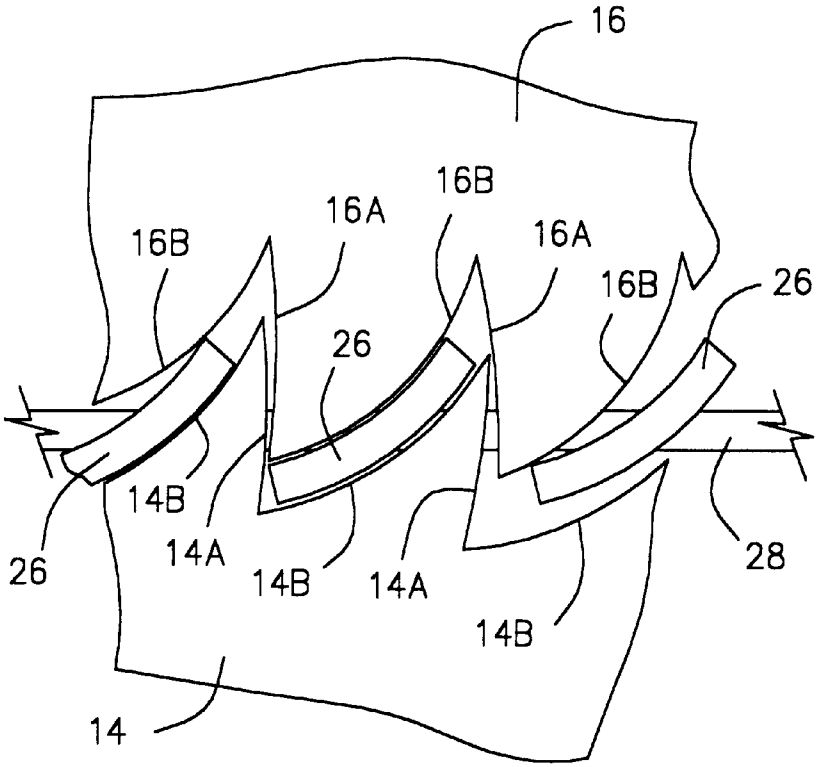
FIG. 3 is an enlarged view of the fin strip of FIG. 1 that has been serrated and is being coined by the first set of wheels in FIG. 1.
Figure 4:
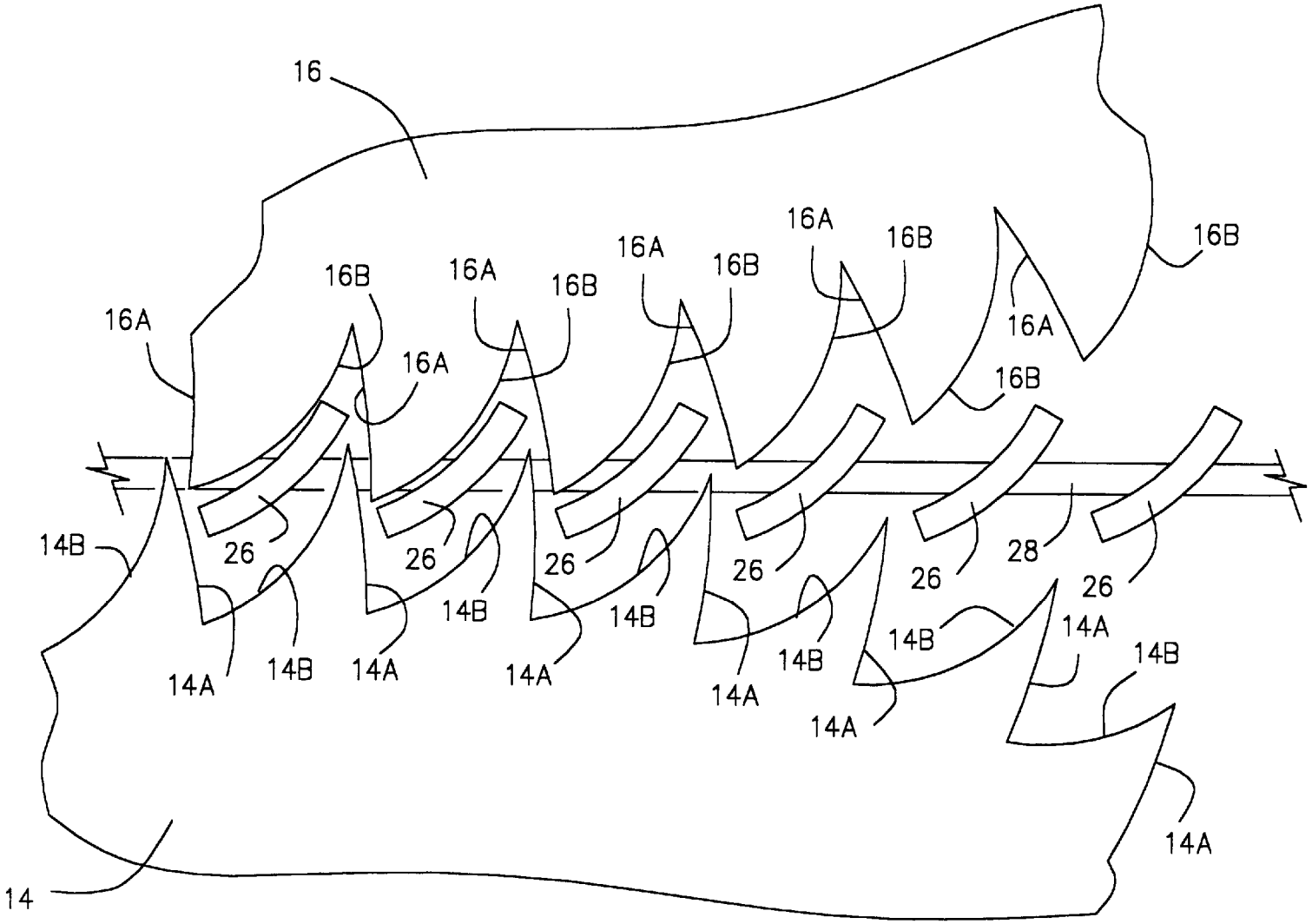
FIG. 4 is an enlarged view of the serrated and coined fin strip as it exits the first set of wheels in FIG. 1.
Figure 10:
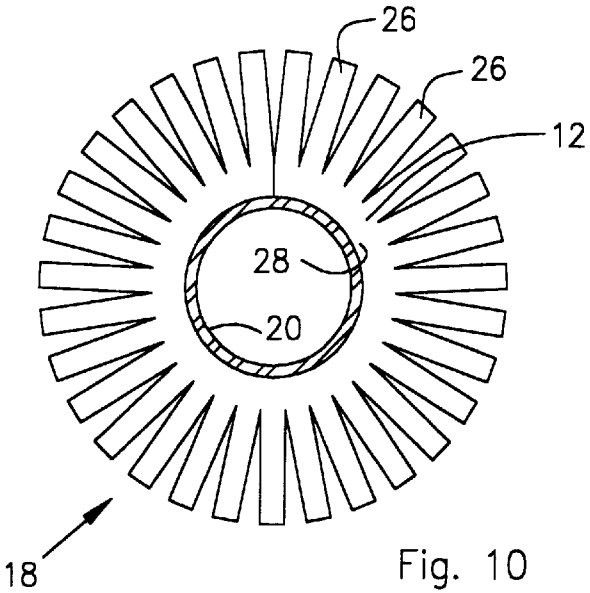
FIG. 10 is an end view of a finned tube constructed with the fin and tube of FIGS. 6 and 7.
Figure 6:
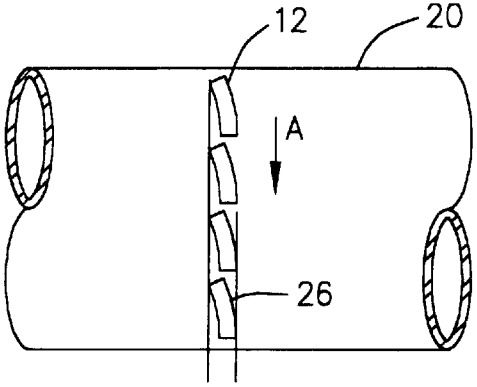
FIG. 6 is a side view of a heat exchange tube to which the fin of FIG. 5 is being attached.
Figure 11:
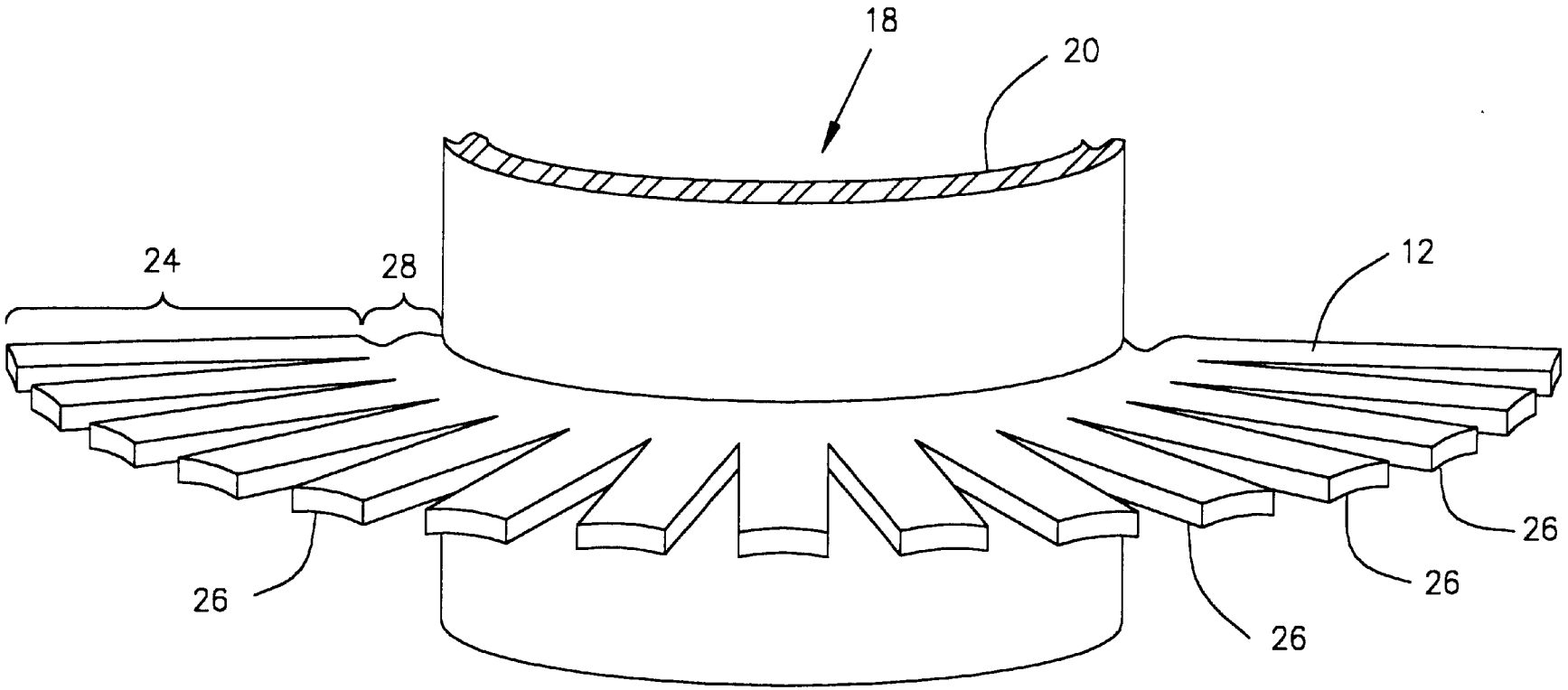
FIG. 11 is a cut away perspective view of a portion of the finned tube of FIG. 10 with the finned tube cut in half along its longitudinal axis for ease in viewing.
Figure 12:
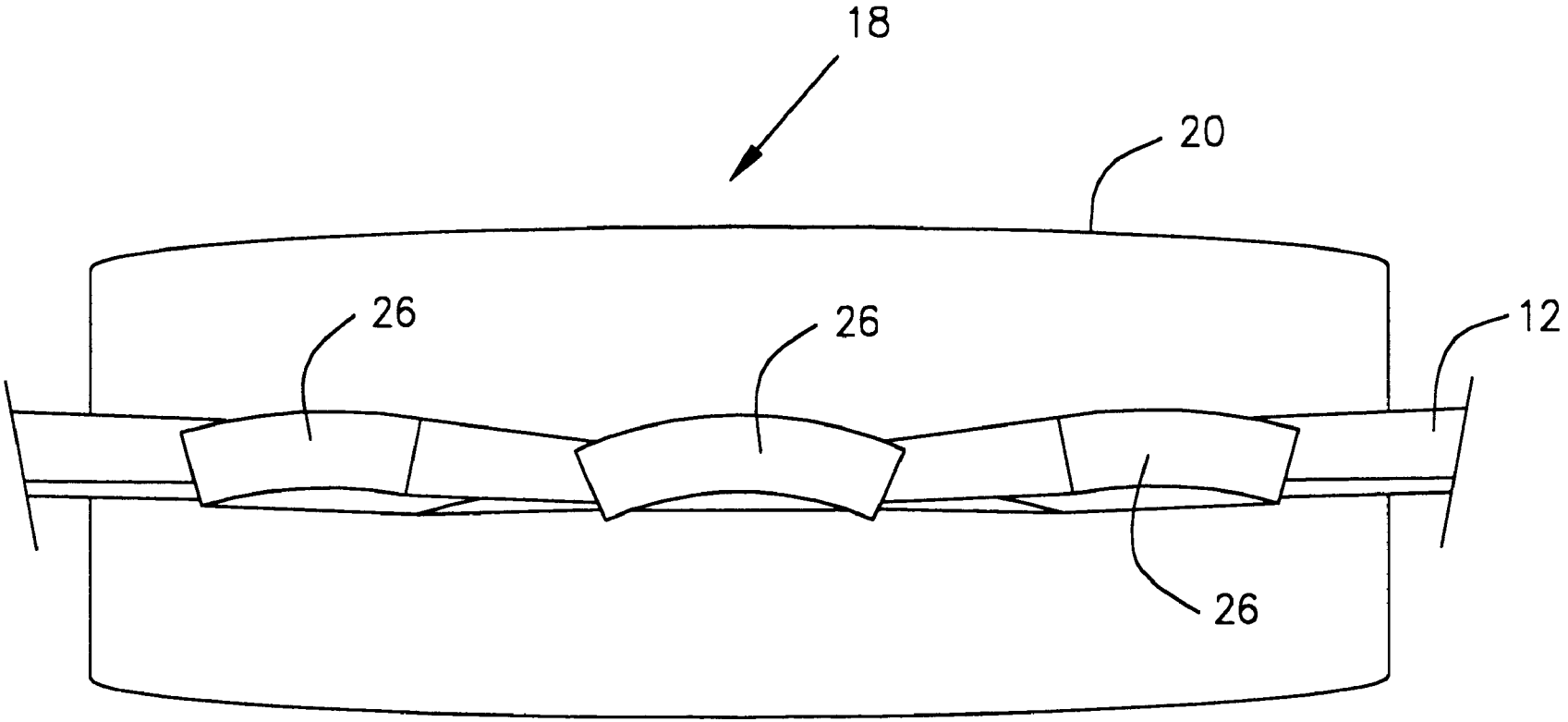
FIG. 12 is a side view of the finned tube of FIG. 11.

Referring now to the drawings, and initially to FIG. 1, there is illustrated a method or process 10 in accordance with a preferred embodiment of the present invention for creating a new type of segmented fin 12. Referring also to FIGS. 2–4, there is illustrated specially designed serrating wheels 14 and 16 constructed in accordance with a preferred embodiment of the present invention for creating the new type of segmented fin 12. Referring to FIGS. 4–7, there is illustrate the new type of segmented fin 12 that is produced by employing the specially designed serrating wheels 14 and 16 and the process 10 illustrated in FIG. 1. Finally, referring to FIGS. 10–12, there is illustrated a unique type of finned tube 18 constructed in accordance with a preferred embodiment of the present invention from a heat exchange tube 20 and the new type of segmented fin 12.

The method 10 involves first passing a flat metal fin strip 22 between the rotating two specially designed serrating wheels 14 and 16. Each of the specially designed serrating wheels 14 and 16 is provided with a plurality of cutting edges, 14A and 16A respectively, provided around a perimeter, 14P and 16P respectively, provided on the wheels 14 and 16. One of the wheels 14 is provided with a plurality of concave surfaces 14B, with one such concave surface 14B being located between each adjacent pair of cutting edges 14A provided on the perimeter 14P of that first wheel 14. The other wheel 16 is provided with a plurality of convex surfaces 16B, with one such convex surface 16B being located between each adjacent pair of cutting edges 16A provided on the perimeter 16P of that second wheel 16. The cutting edges 14A and 16A of the two wheels 14 and 16 are aligned with each other in cooperating fashion. When the flat metal fin strip 22 is passed between the wheels 14 and 16, a first longitudinal edge of the flat metal fin strip 22, that will eventually become an outwardly extending side or serrated portion 24 of the segmented fin 12, is serrated by the cooperating cutting edges 14A and 16A of the wheels 14 and 16, forming a plurality of segments 26 in the serrated portion 24. This serration process is shown in FIG. 2. The flat metal fin strip 22 is provided with an opposite second longitudinal edge that will remain unserrated and will form an inwardly extending side or base 28 of the segmented fin 12.

Figure 13:
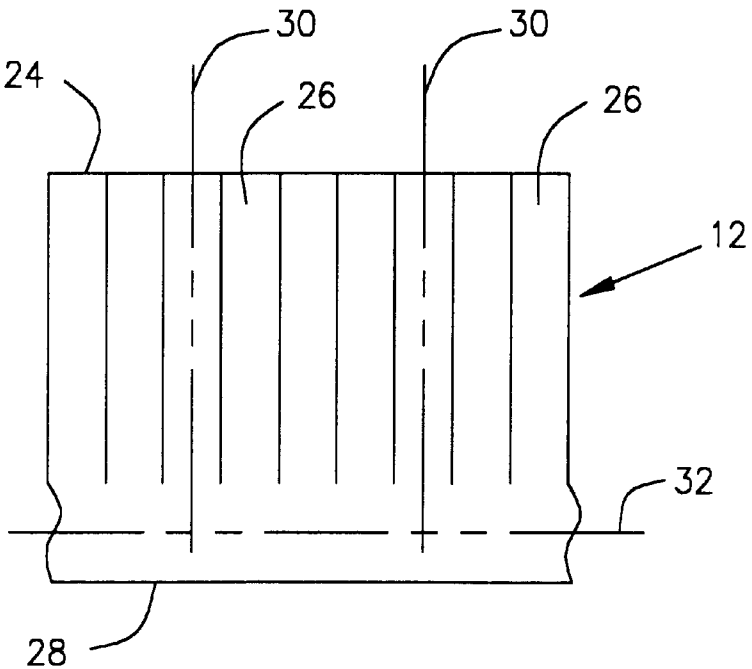
FIG. 13 is a side view of the new type of aerodynamically curved, segmented fin as it exits the final set of wheels in FIG. 1.

As illustrated in FIGS. 1–3, the convex surfaces 16B and concave surfaces 14B of the two wheels 14 and 16 mate together so that as segments 26 in the serrated portion 24 of the segmented fin 12 complete their travel between the wheels 14 and 16, the segments 26 are cold worked by being pressed or coined between the opposing convex and concave surfaces, 16B and 14B. This causes each of the segments 26 to be stressed beyond the metallurgical yield point of the steel metal from which it is formed, and thereby causing each of the segments 26 to be permanently bent into a curved configuration corresponding to the curvature of the mating concave and convex surfaces 16B and 14B. As illustrated in FIG. 13, the longitudinal axis 30 of each of the segments 26 is approximately perpendicular to the longitudinal axis 32 of the base 28 of the segmented fin 12. In addition, the segments 26 are curved in a plane so that a cross section of each of the segments 26 along the longitudinal axis 30 of that segment 26 would cut through the segment 26 in a straight line, forming two mirror image halves of the segment 26. The curvature or arc of each segment 26 is defined by the curvature of the mating concave and convex surfaces 16B AND 14B provided on the specially designed serrating wheels 14 and 16. This curvature is at a radius range of 0.20 inches to 0.30 inches.

Once the serrated and coined fin 12 completes its travel through the first set of wheels 14 and 16, the base 28 of the fin 12 is then engaged by a second set of rotating wheels 34 and 36. The wheels 34 and 36 have a slightly higher surface speed than the first set of wheels 14 and 16 so the second set of wheels 34 and 36 serve to apply a pulling force on the fin 12 in order to pull it clear of the first set of wheels 14 and 16. This pulling force is set large enough to elongate the base 28 of the fin 12 approximately 1–6%, thereby facilitating the subsequent segment realignment. It is important that the second set of wheels 34 and 36 engage only the base 28 of the fin 12 so that the curvatures of the segments 26 are not disturbed.

Finally, after the base 28 of the serrated and coined fin 12 passes between the second set of wheels 14 and 16, the serrated portion 24 of the fin 12 passes through a third set of rotating wheels 38 and 40. The wheels 38 and 40 are precisely positioned relative to each other so that as the segments 26 pass between the wheels 38 and 40, the wheels 38 and 40 push against the segments 26, causing the segments 26 to twist slightly and be pushed back into approximate alignment with the longitudinal axis of the base 28 of the fin 12. However, it is important that during this operation, that the wheels 38 and 40 are spaced apart a sufficient distance so that this operation does not squeeze the segments 26 too tightly and thus does not disturbed the curvature of the segments 26.

Figure 8:
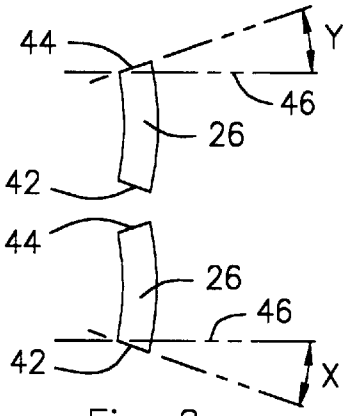
FIG. 8 is an enlarged view of a couple of segments from FIG. 6.

The product of this cold working process is the serrated fin 12 that is provided with curved segments 26. Also because of the coining process that the segments 26 undergo as they pass between the serrating first set of wheels 14 and 16, edges 42 and 44, that are provided on each of the segments 26 at the serrations, are slightly pointed. This is illustrated in FIG. 8 which shows the left and right edges 42 and 44 of each segment 26 being pointed by an angle of, "X" and "Y" respectively, from the normal perpendicular cut 46 that would exist except for the effect of coining on the segment 26. The angles "X" and "Y" will preferably be between 10 and 20 degrees, depending on the force exerting on the segments 26 by the first set of wheels 14 and 16 during the coining process.

Also because of the coining process, surface area of each of the segments 26 is slightly increased over the normal surface area that would have resulted from serrating alone. The surface area is increase by approximately 26% due to the coining.

One of the added benefits of producing the fin 12 with its curved segments 26 is that the segments 26, are inherently stronger than flat or non-curved segments. Increased strength will result in less damage to fin surfaces during manufacturing assembly operations.

The normally weak fin segment has undergone a substantial improvement in resistance to deflection because of two features of the aero curved fin 12. The coining process increases the minimum yield stress by approximately one-third (⅓). In carbon steel fin material, for example, the minimum yield stress changes from approximately 30,000 p.s.i to approximately 40,000 p.s.i. The second improvement comes from the curved shape itself. With dimensions described herein, this improvement can be approximately a 30% increase in resistance to deflection.

Figure 9:
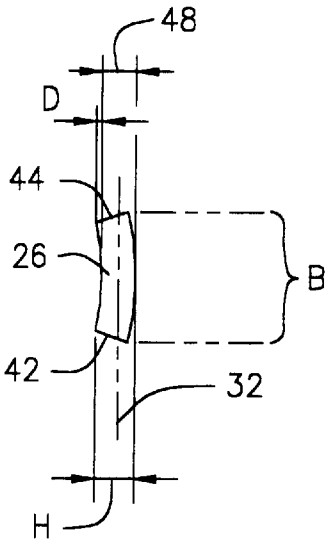
FIG. 9 is an enlarged view of one of the segments from FIG. 8.
Figure 7:
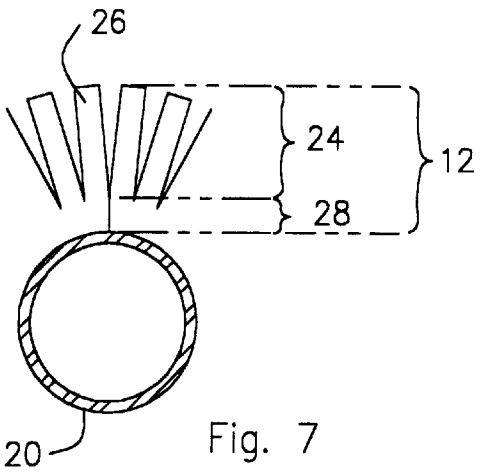
FIG. 7 is an end view of the tube and fin of FIG. 6.

Referring to FIG. 9, a curved fin segment 26 of a height "H" and a base "B" is illustrated. The actual metal thickness of the fin segment 26, not accounting for the curvature of the fin segment 26, is represented in FIG. 9 by the numeral 48. The actual segment metal thickness 48 is less that the height "H" by the amount of the sweep or depth "D" of the curvature of the segment 26.

Figure 5:
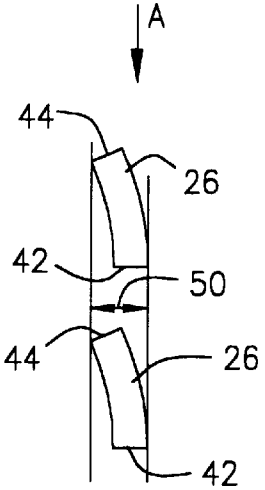
FIG. 5 is an enlarged view of the new type of aerodynamically curved segmented fin as it exits the final set of wheels in FIG. 1.

Referring now to FIG. 5, it is readily apparent that the realignment of the segments 26 by the third set of wheels 38 and 40 does not accomplish a perfect realignment of the segments 26. If the segments 26 were perfectly realigned, then the segments 26 would align so that the multiple fin segment thickness 50 of a row of multiple segments 26 provided on the fin 12, and illustrated in FIG. 5, would be the same as the single fin thickness or height "H", as illustrated in FIG. 9. Instead, the multiple fin segment thickness 50 is greater that the single fin thickness "H" because, as can be seen from FIGS. 5 and 6, the segments 26 are offset somewhat from a perfectly straight alignment with each other, with this offset being a maximum of 0.025 inches. Also, as can be seen from FIG. 5, the fact that the segments 26 are somewhat offset from each other, causes a more aerodynamically desirable orientation of the leading right edge 44 of the segments 26, causing the somewhat pointed edge 44 to face into the oncoming flow of outside gas or liquid, as denoted by arrow "A" in FIGS. 5 and 6. Also, this offset alignment works in conjunction with the curvature of the segments to cause better attachment of the external gas or liquid with the segments 26, resulting in better heat transfer between the segments 26 and the gas or liquid that is flowing over the exterior of the finned tube 18.

Test Results

Figure 14:
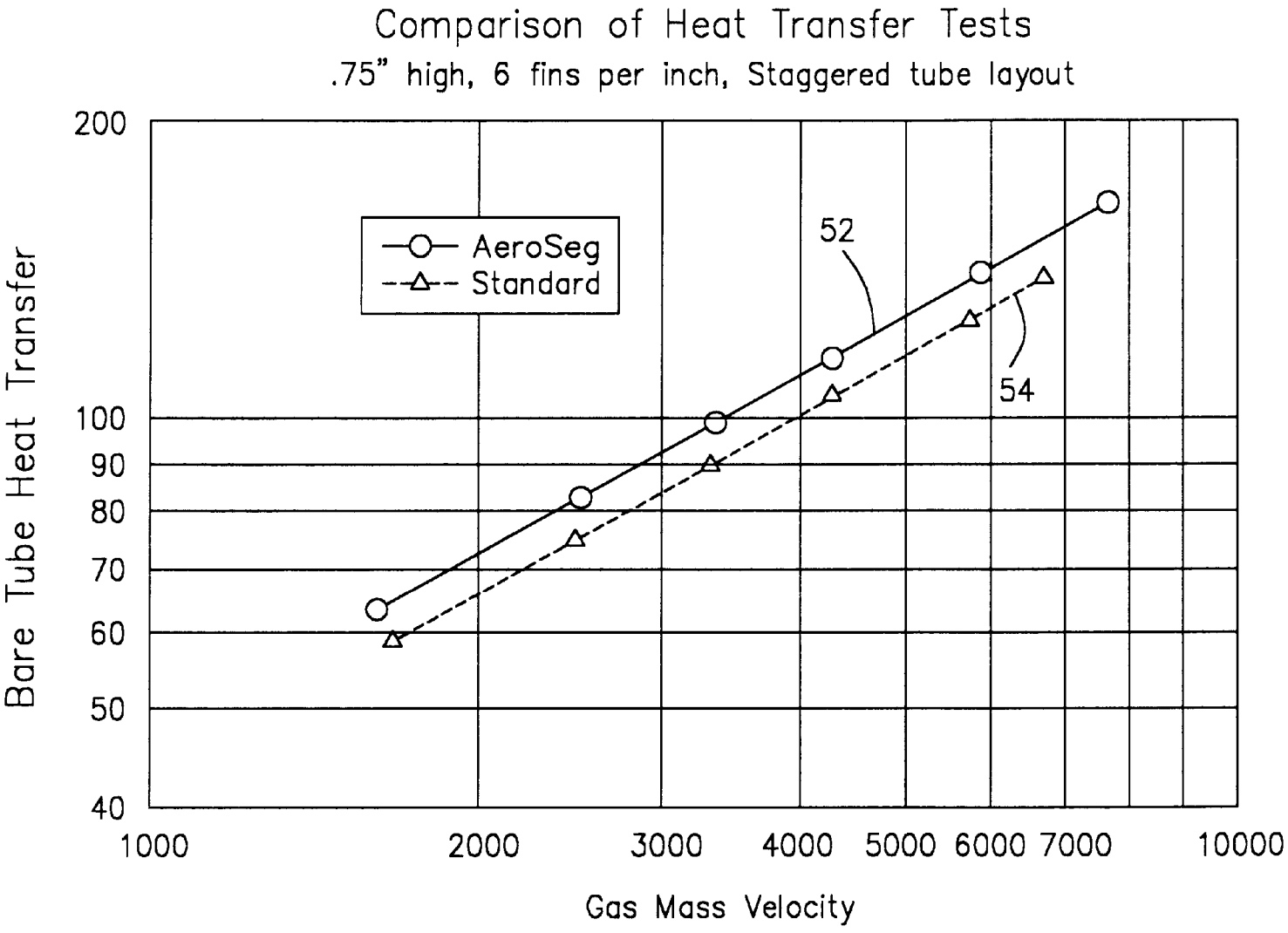
FIG. 14 is a graph showing test results from a comparison of a first finned tube constructed in accordance with the present invention and a prior art finned tube.
Figure 15:
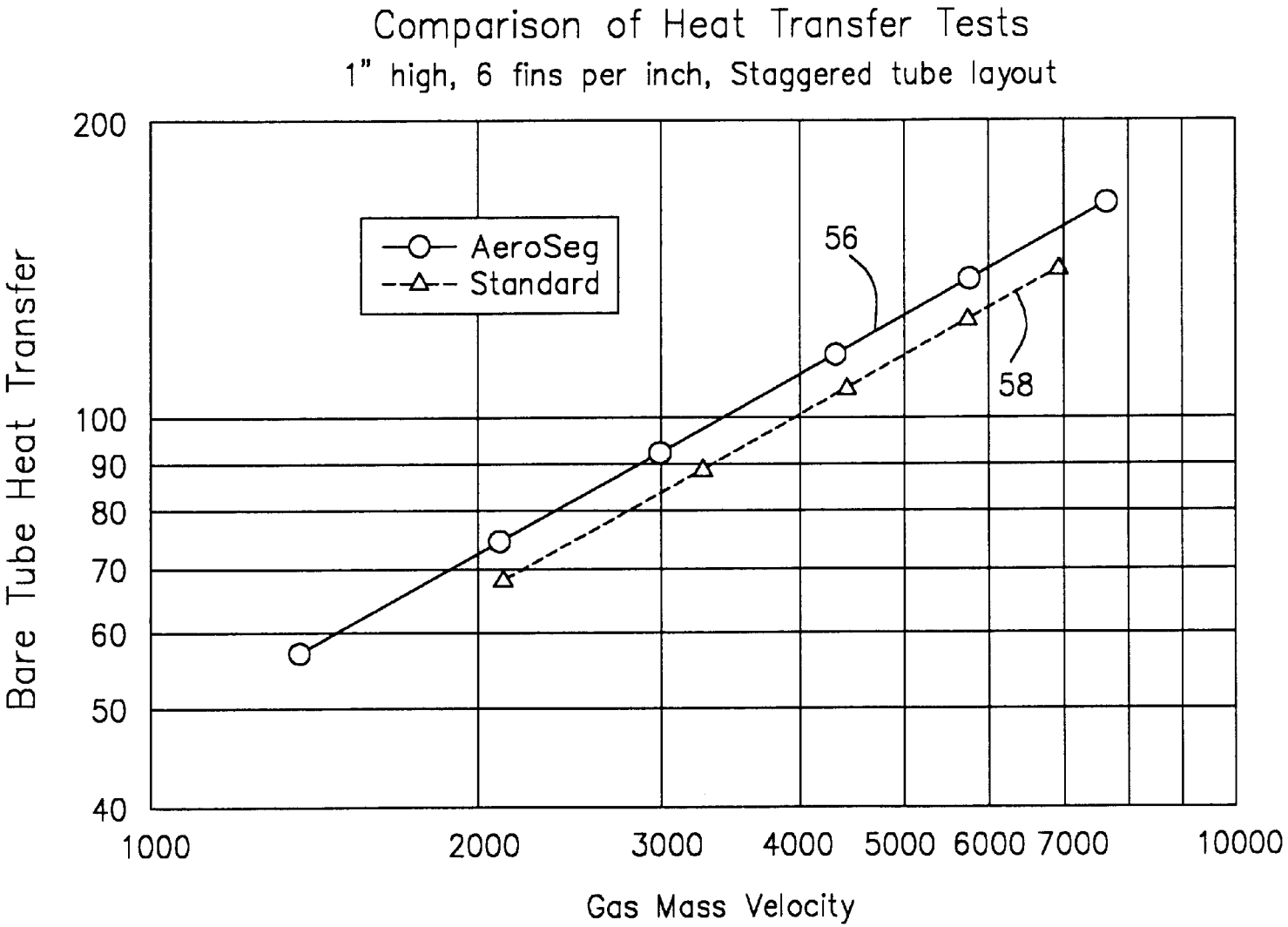
FIG. 15 is a graph showing test results from a comparison of a second finned tube constructed in accordance with the present invention and a prior art finned tube.

Referring now to FIGS. 14 and 15, there are presented charts that show actual test runs that have been conducted by Applicant on finned tubes 18 constructed in accordance with a preferred embodiment of the present invention.

Referring first to FIG. 14, the chart shows a graphical comparison of the heat transfer performance (shown on the vertical axis of the chart in units of BTU/Hour/Square Foot/Degree Fahrenheit) for various gas mass velocities (shown on the horizontal axis of the chart in units of Pounds/Square Foot/Hour) between a finned tube 18 constructed in accordance with the present invention, as indicated by numeral 52, and a standard prior art finned heat exchange tube, as indicated by numeral 54.

Each tube represented in FIG. 14 is one and a half (1½) inch in diameter, each tube is provided with 0.75 inch high serrated fins, and each tube has six (6) fins per inch. Also, both tubes were employed in a staggered tube layout for testing. As the chart clearly shows, the finned tube 18 constructed according to the present invention consistently outperformed a comparable conventional prior art finned heat exchange tube.

Referring next to FIG. 15, this chart also shows a graphical comparison of the heat transfer performance (also shown on the vertical axis of the chart in units of BTU/Hour/Square Foot/Degree Fahrenheit) for various gas mass velocities (also shown on the horizontal axis of the chart in units of Pounds/Square Foot/Hour) between another finned tube 18 constructed in accordance with the present invention, as indicated by numeral 56, and a standard prior art finned heat exchange tube, as indicated by numeral 58.

Each tube represented in FIG. 15 is two (2) inches in diameter, each tube is provided with 1.0 inch high serrated fins, and each tube has six (6) fins per inch. Also, both tubes were employed in a staggered tube layout for testing. As this chart also clearly shows, the finned tube 18 constructed according to the present invention consistently outperformed a comparable conventional prior art finned heat exchange tube.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A perpendicular flow, serrated heat exchange fin that has a base provided along a non-serrated inwardly extending side of the fin and that has an adjacent serrated portion provided along an opposite outwardly extending side of the fin comprising: a plurality of segments provided in a distal serrated portion of a helical, perpendicular flow fin, each said segment being curved into an arc along its width so that each segment has a concave side facing in the same direction, and each said segment being uniform in curvature along its entire length.

2. A heat exchange fin according to claim 1 wherein each said segment is curved in a plane approximately parallel to a longitudinal axis of the base of the fin.

3. A heat exchange fin according to claim 2 wherein each said segment is provided with a curvature radius within the range of 0.20 inches to 0.30 inches.

4. A heat exchange fin according to claim 3 wherein each said segment is coined as it is serrated in order to increase the surface area of the individual segment.

5. A heat exchange fin according to claim 4 wherein serrated edges of each segment are oriented at a slight angle from perpendicular to the longitudinal axis of the base of the fin.

6. A heat exchange fin according to claim 5 wherein the serrated edges are oriented at an angle that is between 10 and 20 degrees from perpendicular to the longitudinal axis of the base.

7. A heat exchange fin according to claim 6 wherein adjacent segments are offset slightly from each other relative to the longitudinal axis of the base, and said segments being offset from each other a maximum of 0.025 inches.

8. A perpendicular flow, heat exchange finned tube comprising:

a cylindrical, perpendicular flow heat exchange tube, a base of a serrated, perpendicular flow fin wound helically around said cylindrical heat exchange tube so a serrated portion of the fin extends outward from the tube, a plurality of segments being provided in said serrated portion, each said segment being curved into an arc along its width so that each segment has a concave side facing in the same direction, and each said segment being uniform in curvature along its entire length.

9. A heat exchange finned tube according to claim 8 wherein each said segment is curved in a plane approximately parallel to a longitudinal axis of the base of the fin.

10. A heat exchange finned tube according to claim 9 wherein each said segment is provided with a curvature radius within the range of 0.20 inches to 0.30 inches.

11. A heat exchange fin according to claim 10 wherein each said segment is coined as it is serrated in order to increase the surface area of the individual segment.

12. A heat exchange fin according to claim 11 wherein serrated edges of each segment are oriented at a slight angle from perpendicular to the longitudinal axis of the base.

13. A heat exchange fin according to claim 12 wherein the serrated edges are oriented at an angle that is between 10 and 20 degrees from perpendicular to the longitudinal axis of the base.

14. A heat exchange fin according to claim 13 wherein adjacent segments are offset slightly from each other relative to the longitudinal axis of the base, and said segments being offset from each other a maximum of 0.025 inches.

* * * * *